US006152032A

United States Patent [19]

Belanger et al.

[11] Patent Number: 6,152,032

[45] Date of Patent: Nov. 28, 2000

[54] MIST CONTAINMENT SYSTEM FOR A SPRAY DAMPENER SYSTEM

[75] Inventors: James Richard Belanger, Portsmouth; Douglas Joseph Dawley, Epping, both of N.H.

[73] Assignee: Heidelberger Druckmaschinen AG, Heidelberg, Germany

[21] Appl. No.: 09/186,436

[22] Filed: Nov. 5, 1998

[51] Int. Cl.[7] ..... B41L 25/06

[52] U.S. Cl. ..... 101/147; 101/148

[58] Field of Search ..... 101/147, 148

[56] References Cited

U.S. PATENT DOCUMENTS

| | | | |
|---|---|---|---|
| 2,063,672 | 12/1936 | Goddard | 101/147 |
| 2,853,941 | 9/1958 | Brandt et al. | 101/147 |
| 2,856,848 | 10/1958 | Pritchard | 101/147 |
| 3,025,789 | 3/1962 | Huebner | 101/147 |
| 3,093,067 | 6/1963 | Huebner et al. | 101/147 |
| 3,139,028 | 6/1964 | Huebner et al. | 101/147 |
| 5,438,923 | 8/1995 | Schoeps | 101/147 |
| 5,596,930 | 1/1997 | Keller et al. | 101/147 |
| 5,644,981 | 7/1997 | Ohno et al. | 101/147 |
| 5,758,580 | 6/1998 | Murray | 101/147 |
| 5,813,332 | 9/1998 | Reichel-Langer et al. | 101/147 |
| 5,878,663 | 3/1999 | Krzyzak et al. | 101/148 |

FOREIGN PATENT DOCUMENTS

| | | |
|---|---|---|
| 622 359 | 12/1935 | Germany . |
| 0-220802 | 8/1997 | Japan . |
| 9-226090 | 9/1997 | Japan . |
| WO 97/27052 | 7/1997 | WIPO . |

*Primary Examiner*—Ren Yan
*Assistant Examiner*—Amanda B. Sandusky
*Attorney, Agent, or Firm*—Kenyon & Kenyon

[57] ABSTRACT

A mist containment system including shieldings (6, 7) assigned to a rotating surface (2). Gaps (4, 5) are created between the shielding (6, 7) and the rotating surface (2). Mist contained within the shieldings (6, 7) is kept within the shielding (6, 7) and prevented from escaping through the gaps (4, 5) either by a negative pressure differential device creating a negative pressure differential across the gaps (4, 5) or in alternative by a condensation device (17) condensing solution which is collected by gravity or by electrostatic charging the spray particles contained in the mist as well as the rotating surface (2).

14 Claims, 3 Drawing Sheets

MIST CONTAINMENT SYSTEM FOR A SPRAY DAMPENER SYSTEM

FIELD OF THE INVENTION

The present invention relates to an active mist containment system for a spray dampener system for use in web press applications, for commercial and newspaper purposes.

BACKGROUND OF THE INVENTION

Japanese publication No. JP-Hei 9-226090, published Sep. 2, 1997, discloses a spray type dampening unit and detector. To rapidly and accurately detected defective printed matter by providing a light emitting part which emits light to a jet of water and a light receiving part which receives the light transmitted through the water near the injection aperture of a wetting water supply nozzle on an offset rotary press, the wetting water is detected by a water detecting part based on a signal from the light receiving part. A light emitting part consisting of a modulator, a cable and a light emitter and a light receiving part consists of a light receiver, an amplifier and an A/D converter which are grouped together. About 95% of the quantity of light emitted to a wetting water from the light emitter is transmitted through the wetting water and the quantity of the received light is measured by the light receiver. The light being emitted by the light emitter is perpendicularly projected to the water level of the wetting water. The light receiver has a photoelectric conversion element and a voltage to be output by the conversion element, amplified by the amplifier, as the voltage is very low. Furthermore, the voltage is subjected to an A/D conversion process. A controller receives an output signal from the light receiving part and a wetting water supply signal to be given to a wetting water supply device and determines whether or not the wetting water is actually supplied.

In Japanese publication JP-Hei 9-220802, published on Aug. 26,1997, likewise a spray type dampening unit and detector is disclosed. Ring water injection nozzles are provided at almost a specified interval, and a set of a generator and a wave receiving part are installed near the jet aperture of the wetting water injection nozzle. An energy wave which is projected from the generator for generating a low or a high frequency wave, an ultrasonic wave or an air pressure wave is emitted to the water level of the wetting water, being transmitted through the wetting water and reflected by a reflecting part. In addition, the energy wave is reflected by the surface of the wetting water and is received by a wave receiving part. At the wave receiving part the energy wave is subjected to an AID conversion after amplification.

Both Japanese documents show a protective element which surrounds the dampening fluids spray nozzles and which is assigned to a respective cylinder. However, both disclosures are silent with regard to mist containment.

Spray dampeners are well known in the cold set printing industry. Existing embodiments of mist containment systems consist of tightly fitting shields which create physical barriers to contain the mist. At the onset of misting some mist will escape the standard shielding. As more mists collects, the concentration inside the containment area increases until saturation. Once the air cannot hold anymore solution the mist either escapes through the gaps or is condensed on the inside surfaces of the shields where it collects. In the case where the spray is applied to a moving surface such as a cylinder, there must be a gap between the guard and the application surface. If this gap is too small any disturbances or vibrations can cause the guard to disrupt the surface. If the gap is too large, the mist will not be sufficiently contained and will defuse into the local environment. The basic problem with the existing embodiments is that they do not provide a controllable means for the removal of mist from the containment area. One approach to eliminate the above-mentioned deficiencies of the known solution was to minimize the gaps on existing mist containment shields, in order to restrict the release of mist. Some embodiments include a gravity fed drain where the pooled up solution can exit the mist containment area without flowing onto critical portions of the machine, where they detrimentally can affect the quality of the freshly produced printed product.

SUMMARY OF THE INVENTION

Having outlined the problems and difficulties encountered in the field, it is accordingly an object of the present invention to actively contain mist produced by a spray dampener.

Still further, it is an object of the present invention to remove mist produced by a spray dampener.

According to the present invention, a containment system includes:

- a shielding assigned to a rotating surface,
- gaps created between said shielding and said rotating surface, and
- a negative pressure differential device for creating a negative pressure differential across the gaps.

The first embodiment according to the present invention offers several advantages. Instead of using guards which are difficult to seal completely versus a rotating surface, a negative pressure gradient is created with respect to the ambient pressure. Thus, the ambient pressure is used to prevent mist particles from escaping via gaps in the containment area. Via a pressure-seal the mist is kept effectively from leaving the containment area and without disturbing accessibility to the rotating surface by a tight fitting guard.

According to further details of said first embodiment, the negative pressure differential device may be a sucking device such as a pump. It is conceivable as well to use a Venturi nozzle for creating negative pressure gradient. Within the containment area created between the shieldings a spray nozzle is arranged in the nominal center line thereof. A separator unit may be assigned to the sucking device, the separator including a separation element, separating solution from air. The solution separated from the air may be collected for recirculation thereof or may be disposed of.

The air separated from the solution in the separator unit may escape via an air outlet duct.

A second embodiment according to the present invention discloses a condensation element being arranged within the containment area instead of a pressure differential device. The condensation element may be surrounded by an encapsulation substantially extending in the vertical direction. The condensation element such as a condensation coil may extend from the interior of the containment area through a duct portion into a separation unit assigned to the duct. Within the separation unit the condensed solution is collected at the bottom thereof.

A third embodiment according to the present invention discloses electrostatic charging elements arranged within said containment area, instead of a condensation duct or the negative pressure gradient device.

The electrostatic charging elements apply a negative charge to said mist particles kept in said containment area. At the counter part, i. e. to the surface of the rotating element, a positive charging may be applied attracting said negatively charged mist particles and preventing them from escaping said containment area at respective gaps thereof.

Each of said three embodiments outlined above may be integrated into a spray dampening unit for a rotary offset printing press, i. e. cold set printing industry. Accordingly, the spray dampeners including at least one out of the three embodiments outlined above may be integrated into a printing unit of a rotary printing press, either being web-fed or sheet fed.

BRIEF DESCRIPTION OF THE DRAWINGS

The present invention will be best understood from the following description, in which.

DETAILED DESCRIPTION OF PREFERRED EMBODIMENTS

Figure 1:
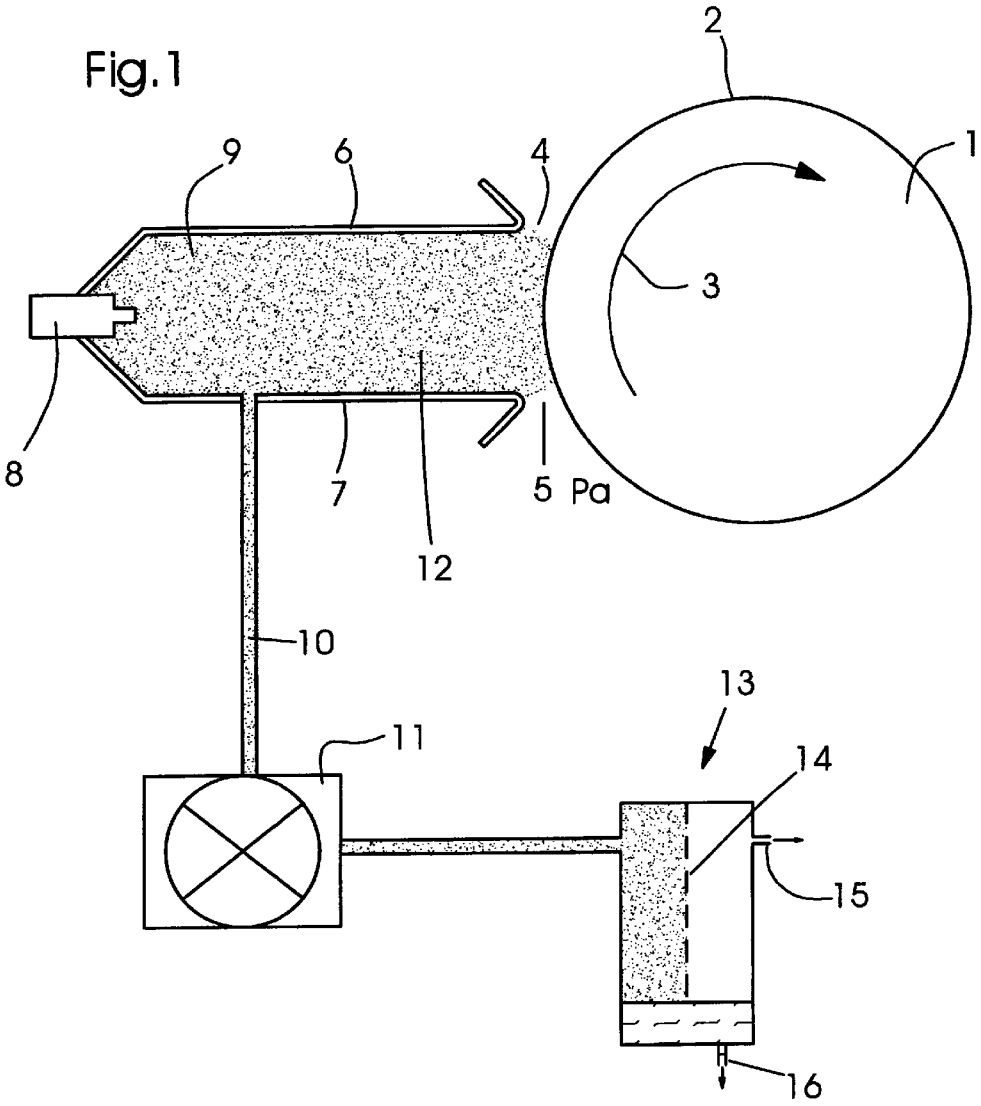
FIG. 1 shows an active mist containing system according to the present invention, creating a negative pressure differential.

FIG. 1 shows an active mist containment system according to the present invention, creating a negative pressure differential.

A rotating element 1 having a surface 2 rotates about its axis as shown in the direction of arrow 3. An upper shielding 6 and a lower shielding 7 are assigned to the rotating surface 2 respectively. The shieldings 6, 7 form respective upper and lower gaps 4, 5. At the rearward end portion of said shieldings 6, 7, respectively, shaping a respective containment area 9, a spray nozzle 8 is mounted oriented about a nominal center line of said shielding 6, 7, respectively. A connecting pipe 10 connects said containment area 9 to a sucking device 11 such as a pump. To the sucking device 11 a separator unit 13 is assigned, comprising a separation 14. Within said separator unit 13 the mist, i. e. a solution/air-mixture is separated, so as to collect solution on the bottom of said separator unit 13 and to have the separated air escape from said separator unit 13 via an air outlet 15. Said collected solution may either be recirculated for a further use cycle or may be disposed of. Said solution will be taken from said separator unit 13 via outlet 16.

Figure 1A:
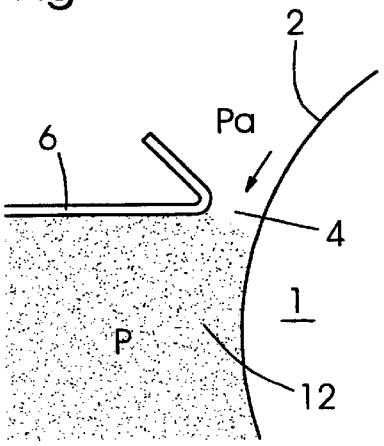
FIG. 1*a* shows a detail of the containment system, preventing mist from escaping said containment area.

FIG. 1*a* shows a detail of a first embodiment of the present invention given in FIG. 1.

In the stage given in FIG. 1*a* said sucking device such as a pump 11 has created a negative pressure gradient within said containment area 9. Said gap 4 is created by the surface 2 of said rotating elements 1 such as a roller and a hook-shaped edge of said upper shielding 6. Since a pressure lower as compared to the ambient pressure $p_{ambient}$ is created, said mist particles 12 will stay within said containment area 9 and will not escape through said respective gap 4 into the surrounding of said shielding 6, 7.

Figure 1B:
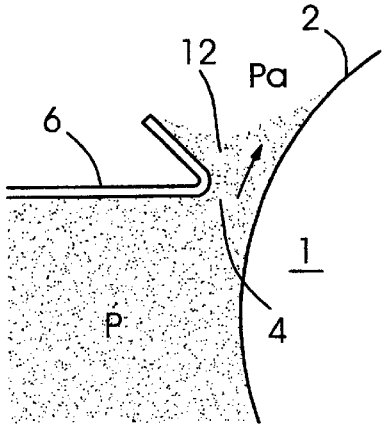
FIG. 1*b* shows a pressure differential being $p>p_{ambient}$, consequently mist escaping from said shielding.

FIG. 1*b* on the other hand shows a pressure differential, where $p>p_{ambient}$ consequently mist will escape from said shieldings.

In FIG. 1*b*, which represents the situation encountered in the technical field, the pressure p is higher as compared to $p_{ambient}$ in the surrounding of said shielding 6, 7, respectively. Due to the situation shown here, mist particles 12 escape through said gap 4 and cannot be kept within said containment area 9, since the pressure differential here favors the escape of said mist particles through said gap.

Figure 2:
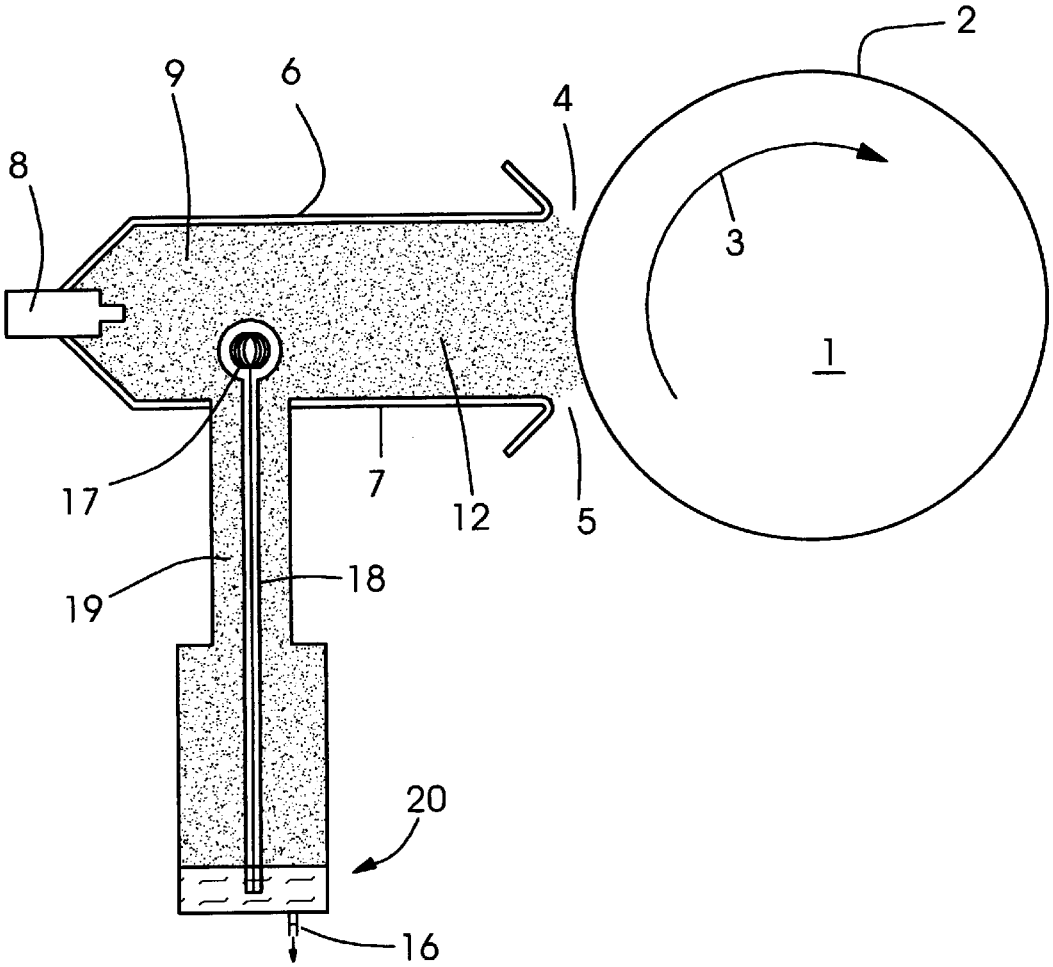
FIG. 2 shows a mist containment system including a condensator to collect condensed solution.

FIG. 2 shows a second embodiment of a mist containment system including a condensator to collect condensed solution.

In this second embodiment of thc present invention, a condensation element 17 is located within said containment area 9 between said upper and lower shieldings 6, 7, respectively. Said condensation element 17 such as a condensation coil is surrounded by an encapsulation 18, substantially extending in the vertical direction. Said condensation element 17 extends through a duct-shaped portion 19 connecting said condensation coil with a separator unit 20 arranged below said duct-shaped portion 19. Upon a cooling of said condensation element 17 solution condenses at the respective surface thereof and will collect due to gravity at the bottom of said separator unit 20. Said condensed solution either can be recirculated via solution outlet 16 or can bc disposed of.

Spray is applied to said containment area 9 using a spray nozzle 8. As already has been described in connection with the first embodiment of the present invention said gaps 4, 5, respectively, are formed between a surface 2 of a rotating element 1 and respective hook-shaped edges of said shielding 6, 7, respectively. Portions of said lower shielding 7 connect to said duct 19 may be arranged in a inclined position with regard to said duct entry 19 so as to allow for collection of the condensed solution within said duct 19.

Figure 3:
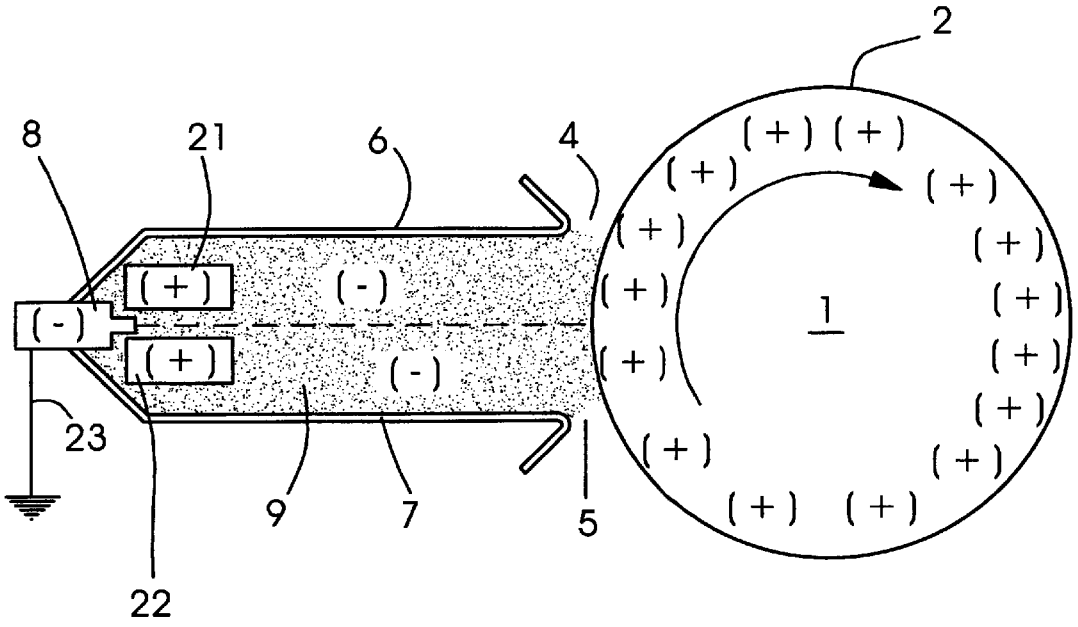
FIG. 3 shows a mist containment system employing electrostatic charging of components.

FIG. 3 shows a third embodiment of the present invention disclosing a mist containment system comprising electrostatic charging elements.

In this embodiment of a mist containment system, a spray nozzle 8 is charged negatively and connected to ground 23. Within said containment area 9 an tipper and a lower electrostatic charging plate 21, 22 respectively are arranged, to move said mist particles 12 towards a rotating surface 2, which in turn is positively charged. The mist particles 12 are given a negative charge upon exiting said spray nozzle 8. Since the surface 2 of the spray roll 1 is positively charged, said mist particles 12 will be attracted by said positively charged surface 2. The clouds of mist generated during the spraying process are negatively charged and consequently will be attracted as well by said positively charged rotating surface 2 of a spray roll 1, to give an example.

The three embodiments given here, apply mechanical principles such as a creation of a pressure differential or the condensation principle using said condensation element and finally applying in the third embodiment electrostatic principles to prevent mist particles form escaping a containment area 9. Each of said given embodiments can be used in a spray dampener assigned to a printing unit or a web-fed or sheet-fed rotary printing press. Regardless of what principle for containing mist is chosen, the application of the respective embodiment will significantly reduce spray mist condensation on critical parts of the printing press and will help eliminating gravity fed drain designs and will prevent solution droplets from spoiling a high quality printed product.

List of Parts

1 rotating element
2 rotating surface
3 sense of rotation
4 upper gap

5 lower gap
6 upper shielding
7 lower shielding
8 spray nozzle
9 containment area
10 supply line
11 pump
12 mist
13 separator unit
14 separation
15 air outlet
16 solution outlet
17 condensation coil
18 encapsulation
19 duct
20 separator
21 upper charging plate
22 lower charging plate
23 guard
24 charged surface
p pressure inside shielding
$p_{ambient}$ pressure outside shielding

What is claimed is:

1. A containment system comprising:

an upper and a lower shielding assigned to a rotating surface forming a single continuous containment area, gaps being formed between the upper shielding and the rotating surface and between the lower shielding and the rotating surface; and a suction device, the suction device being directly connected to the container area and creating a negative pressure in the containment area with respect to the ambient pressure; and a spray nozzle located within the containment area, the spray nozzle creating mist in the containment area.

2. The containment system according to claim 1, wherein the suction device is a pump.

3. The containment system according to claim 1, wherein the suction device includes a Venturi-nozzle.

4. The containment system according to claim 2, further comprising a separator unit assigned to the suction device.

5. The containment system according to claim 4, wherein the separator unit includes a separation element separating solution from air.

6. The containment system according to claim 4, wherein the separator unit includes a collector for collecting solution for recirculation.

7. The containment system according to claim 4, wherein separated air escapes by an air outlet.

8. A containment system comprising:

an upper and lower shielding assigned to a rotating surface, the upper and lower shielding forming a single continuous containment area, gaps being created between the upper shielding and the rotating surface and between the lower shielding and the rotating surface, the upper and lower shielding and the rotating surface forming a containment area;

a spray nozzle arranged within the containment area, the spray nozzle creating mist in the containment area; and a condensation element extending into and located within the containment area.

9. The containment system according to claim 8, further comprising an encapsulation surrounding the condensation element.

10. The containment system according to claim 8, further comprising a separation unit the condensation element extending from the containment area through a duct to the separation unit.

11. The containment system according to claim 10, wherein the separation unit collects condensed solution on a bottom of the separation unit.

12. A containment system comprising:

an upper and lower shielding assigned to a rotating surface, gaps being created between the upper shielding and the rotating surface and between the lower shielding and the rotating surface, the upper and lower shielding forming a single continuous containment area;

a spray nozzle located within the containment area, the spray nozzle creating mist in the containment area and applying a negative charge to the mist particles within the containment area.

13. The containment system according to claim 12, wherein the rotating surface is charged positively.

14. The containment system according to claim 12, further comprising:

a first and second electrostatic charging plate, said first and second electrostatic charging plates being positively charged.

* * * * *